US007220024B1

(12) United States Patent
Berends

(10) Patent No.: US 7,220,024 B1
(45) Date of Patent: May 22, 2007

(54) DISPOSABLE WORK LIGHT

(76) Inventor: Boyd E. Berends, 10519 Summer Grove Ct., Zeeland, MI (US) 49464

( * ) Notice: Subject to any disclaimer, the term of this patent is extended or adjusted under 35 U.S.C. 154(b) by 206 days.

(21) Appl. No.: 11/009,932

(22) Filed: Dec. 13, 2004

(51) Int. Cl.
*F02V 7/00* (2006.01)

(52) U.S. Cl. ..... 362/296; 362/109; 362/231; 362/396

(58) Field of Classification Search ..... 362/216, 362/260, 294, 373, 285, 396, 399; 313/634, 313/623, 493
See application file for complete search history.

(56) References Cited

U.S. PATENT DOCUMENTS

| | | | | |
|---|---|---|---|---|
| 1,932,143 | A | 10/1933 | Piercy | |
| 2,279,635 | A | 4/1942 | Morley | |
| 2,489,686 | A | 11/1949 | Suter | |
| 2,677,753 | A | 5/1954 | Heinz | |
| 2,861,175 | A | 11/1958 | Schweikle | |
| 2,874,270 | A | 2/1959 | Douglass et al. | |
| 3,755,668 | A * | 8/1973 | Moreschini | 362/282 |
| 3,815,080 | A | 6/1974 | Summa | |
| 3,953,761 | A | 4/1976 | Giudice | |
| 4,141,062 | A | 2/1979 | Trueblood | |
| 4,262,327 | A * | 4/1981 | Kovacik et al. | 362/223 |
| 4,275,435 | A | 6/1981 | Dorn | |
| 4,352,539 | A | 10/1982 | Vest | |
| 4,419,720 | A * | 12/1983 | Kenney | 362/285 |
| 4,503,360 | A * | 3/1985 | Bedel | 315/112 |
| 4,864,477 | A * | 9/1989 | Engelman | 362/376 |
| 4,878,159 | A | 10/1989 | Blaisdel et al. | |
| 5,130,910 | A | 7/1992 | Engel | |
| 5,135,407 | A | 8/1992 | Berends | |
| 5,170,332 | A | 12/1992 | Browne | |
| 5,975,719 | A | 11/1999 | Reiff et al. | |
| 6,386,736 | B1 | 5/2002 | Reiff et al. | |
| 7,004,605 | B1 * | 2/2006 | Galvez | 362/451 |
| 2005/0258760 | A1 * | 11/2005 | Yan | 313/634 |

* cited by examiner

*Primary Examiner*—Ali Alavi

(57) ABSTRACT

A disposable work light including an electrically non-conductive base provided with an electrically conductive terminal adapted to be detachably coupled to a complementally formed electrical socket. An elongate hollow electrically non-conductive cylindrical housing is cantileverly mounted on the base and includes a reflector on one lateral side of a lamp and a translucent housing portion on the laterally opposite of the lamp for passing the reflected, concentrated light to a work site. A transversely disposed, resilient vibration dampener and seal plate is mounted on the base for sealing the work light to the socket and for vibrationally isolating the lamp from the socket.

68 Claims, 3 Drawing Sheets

Fig. 3
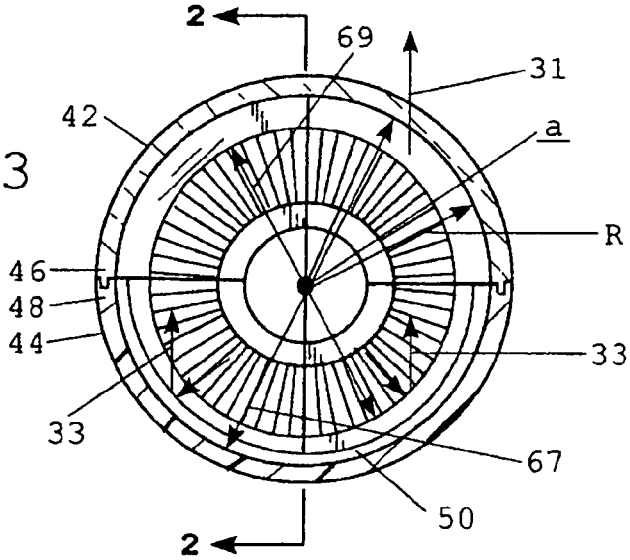
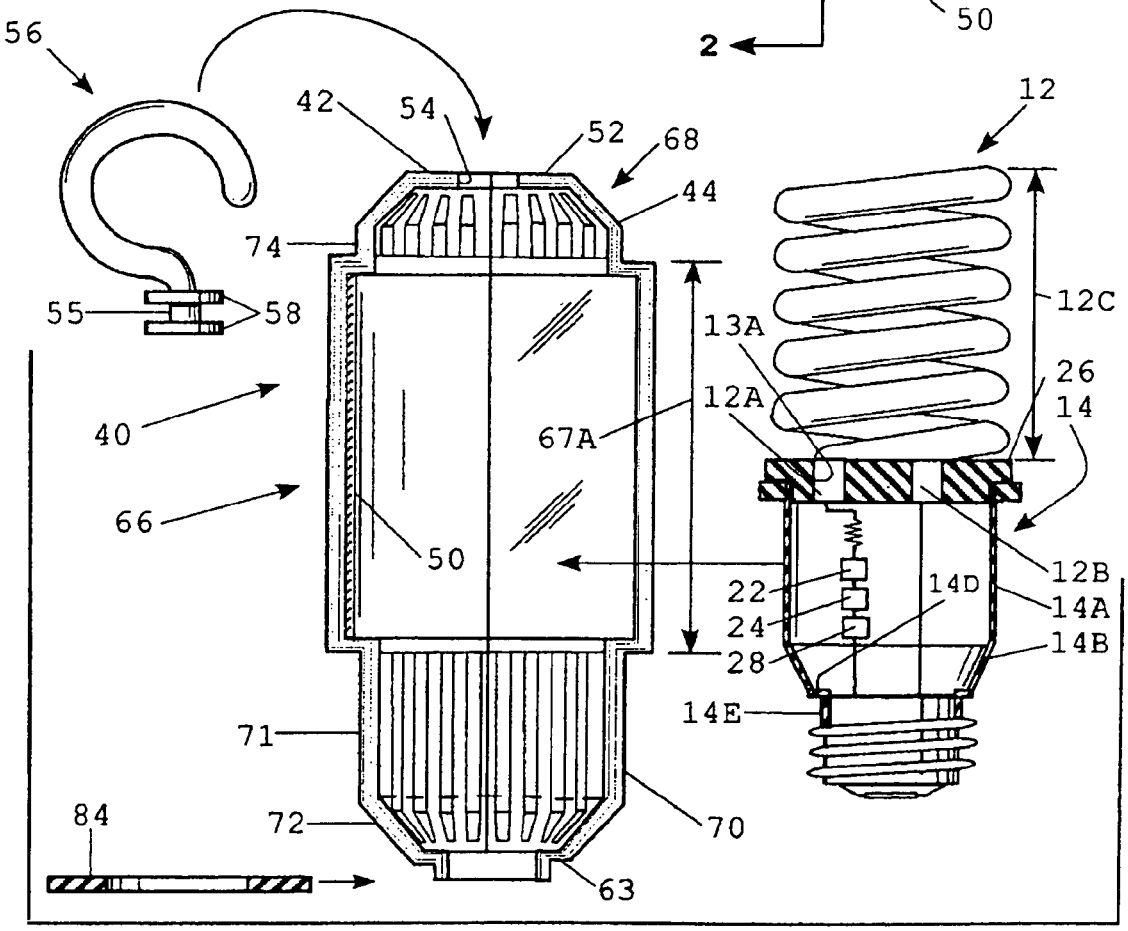
Fig. 4

DISPOSABLE WORK LIGHT

BACKGROUND OF THE INVENTION

1. Field of the Invention

This invention relates to a portable work light and more particularly, to a disposable work light having a protective and reflectorized housing permanently mounted on the housing lamp.

2. Description of Prior Art and Advantages

Traditionally, trouble lights, such as that disclosed in U.S. Pat. No. 4,275,435 issued to Henry M. Dora on Jun. 23, 1981; U.S. Pat. No. 2,861,175 issued to O. W. Schweikle on Nov. 18, 1958; U.S. Pat. No. 2,677,753 issued G. W. Heinz on May 4, 1954; and U.S. Pat. No. 4,141,062 issued to Raymond L. Trueblood on Feb. 20, 1979, include incandescent lamps which are threadedly received in a complementally formed electrically conductive, threaded, metal light bulb socket that is disposed in, and transversely moveable relative to, a surrounding rubber handle in which the socket is disposed. Incandescent lamps are fragile. If the traditional trouble light is dropped or bumped, the incandescent lamp filament is easily broken. It is an advantage of the present invention to provide a portable work light which will resist lamp breakage due to drops and bumps.

A substantial amount of heat radiates from incandescent bulbs causing the bulbs to be very hot and subject the user to being burned. The generated heat can also ignite certain inflammable gases and liquids, if inadvertently introduced to the heated incandescent lamp. A hot incandescent lamp can explode if splashed with even one drop of water.

To overcome these problems, trouble lights have been made with linear fluorescent light sources, such as that disclosed in U.S. Pat. No. 5,975,719 issued to Paul J. Reiff, et al on Nov. 2, 1999; U.S. Pat. No. 6,386,736 issued to Paul J. Reiff, et al on May 14, 2002; U.S. Pat. No. 2,489,686 issued to J. L. Suter on Nov. 29, 1949; U.S. Pat. No. 3,815,080 issued to Frank Summa on Jun. 4, 1974 and U.S. Pat. No. 2,874,270 issued to H. E. Douglas, et al on Feb. 17, 1959. Such elongate, linear light bulbs are bulky, clumsy and limited in their light output. Linear light sources are not concentrated in a short length for a given voltage as are spiral fluorescent bulbs, such as that disclosed in U.S. Pat. No. 2,279,635 issued to J. Morley on Apr. 14, 1942 and U.S. Pat. No. 3,953,761 issued to Thomas Lo Giudice on Apr. 27, 1976. For example, a 15 watt fluorescent bulb is as bright as a 75 watt incandescent bulb which is generally the upper acceptable recommended watt limit for most trouble light fixtures.

A typical trouble light socket includes a curvilinear metal reflector, fixed to the trouble light handle, extending on one lateral side of the incandescent lamp and a hinged, wire cage along the laterally opposite side of the lamp to protect the lamp from breakage. The prior art housing is mounted on a rubber handle and moveable therewith relative to the bulb subjecting the bulb to breakage. It is an advantage of the present invention to provide a trouble light having a housing which is inseparably fixed to the base of the bulb to limit relative movement therebetween.

It is another advantage of the present invention to provide a reflector housing of the type described which has a relatively short reflectorized portion and a reduced diameter section mounted on the base of the lamp.

Yet another advantage of the present invention is to provide a portable work light including a partially reflectorized protective housing cantileverly inseparably mounted to the lamp.

The housing, constructed according to the present invention, contemplates a pair of semi-cylindrical halves which are permanently mated to each other and to laterally opposite sides of the base of a fluorescent light bulb with one of the semi-cylindrical halves including a light reflecting portion on one lateral side of the bulb and the other half including a translucent section on the laterally opposite side of the bulb for transmitting the reflected light rays emanating from the light source.

The present invention contemplates a new and novel work lamp which has a fluorescent light with an electrically non-conductive base, including a ballast and starter, and a rotary electrically conductive base for being detachably rotatably received in a complementally formed electrical socket and an elongate cylindrical housing fixed to the base for disposal with the lamp when the lamp has outlived its useful life.

Existing trouble lights include an annular gap between the electrically conductive rotary base of the light source and the electrically non-conductive handle, which provides a ready ingress window for flammable gases and liquids that can be ignited. The present invention contemplates a resilient annular guard received by the base of the lamp and projecting radially outwardly therefrom to provide a cover which will span the gap between the lamp and the handle and thus, eliminates inadvertent passage of liquid, such as water, and/or explosive gases therebetween. The radially outer portion of the resilient vibration dampening guard is a resilient seal clamped between the terminal end of the electrically non-conductive handle and the opposing end of the cantileverly supported lamp housing. When the spiral fluorescent light bulb incorporated in the present invention exceeds it useful life and is disposed, the resilient shield and housing will be disposed therewith. Accordingly, it is another advantage of the present invention to provide a disposable work light including a resilient annular safety shield having a bore therethrough received on the base of a fluorescent lamp bulb and spanning the gap the between the bulb and the electrically nonconductive portion of the handle surrounding the base of the bulb.

It is another advantage of the present invention to provide an annular resilient shield which is resiliently mounted on the base of the light source and bears against the end of the electrically non-conductive light mounting handle for stabilizing the bulb and absorbing any shock or force that would otherwise be transmitted from the handle to the bulb.

It is another advantage of the present invention to provide a resilient safety ring which mounts on the base of a lamp and seals to the mounting handle for keeping gas and/or fumes out of electrical contact with the handle supported electrical socket.

It is a further advantage of the present invention to mount a housing and a reflector on the light source as opposed to mounting the reflector on the handle in which the light source is threadedly mounted.

Another advantage of the present invention is to provide a replacement for an incandescent light bulb used in a mechanic's work light and to provide an enhanced versatile work light that is safe to use and provides a variety of light intensities in a compact arrangement.

These and other advantages of the present invention will become more readily apparent as the descriptions hereof proceeds:

SUMMARY OF THE INVENTION

A portable work light including a lamp having a rotary base; an elongate partially reflectorized housing having an axially inner end cantileverly mounted on a base of the lamp for disposal therewith; and a vibration dampener and seal for vibrationally isolating the lamp from a handle into which the lamp is detachably mounted and for sealing the electrical connections within the handle from ambient liquids and ignitable gases.

DESCRIPTION OF THE DRAWINGS

The invention may be more readily understood by referring to the accompanying drawings, in which:

FIG. 3 is a top plan sectional view of the reflector housing only, taken along the section line 3—3 of FIG. 1;

FIG. 4 is an exploded view illustrating the various components of the work light prior to assembly.

DESCRIPTION OF PREFERRED EMBODIMENT

Figure 1:
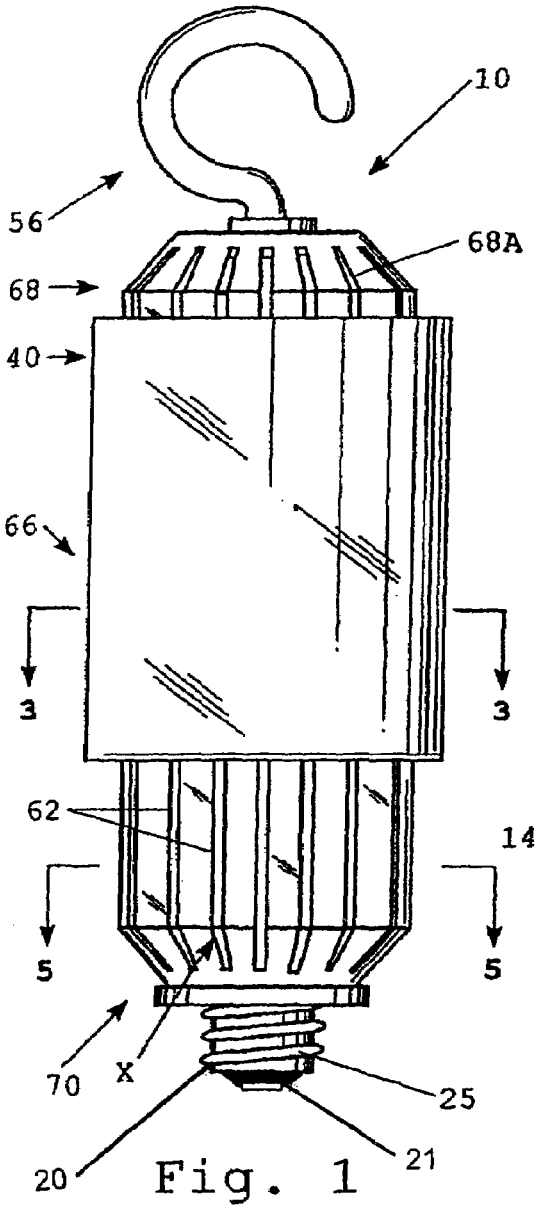
FIG. 1 is a front elevational view of a disposable work light constructed according to the present invention.
Figure 2:
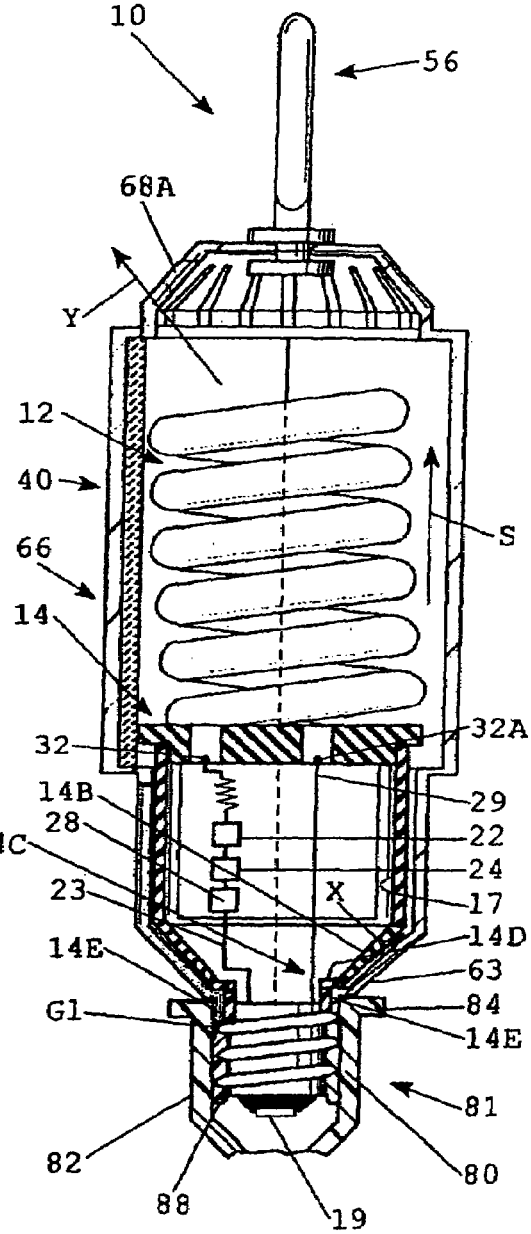
FIG. 2 is a sectional side view thereof, taken along the section line 2—2 of FIG. 3.

A disposable work light, generally designated 10, constructed according to the present invention includes a fluorescent lamp or light source, generally designated 12, including an electrically non-conductive, open top hollow one piece base, generally designated 14, which may comprise any electrically non-conductive material, such as plastic. The open top is closed via an electrically non-conductive cap 26 which is press fit into the open top and has a pair of bulb receiving apertures 13A therethrough. The fluorescent light bulb 12 includes a pair of upstanding glass legs 12A and 12B received in the apertures 13A, coupled to a spiral glass configuration 12C having a relatively short axial length 12D. The base 14 has a cavity 17 which receives a ballast or transformer 22, a starter 24 and other assundry electronic circuitry 28 electrically coupled, via line 23, between one terminal 32 of the fluorescent bulb 12 and a central terminal 19 insulated from an electrically conductive rotary metal screw shell or base 20 via a strip of insulation 21. The electrically non-conductive housing 14 includes a hollow cylindrical sidewall 14A integrally coupled to a frustoconically shaped, axially inner wall portion 14B having a radially inwardly extending inverted integral L-shaped flange 14C provided with a transversely extending annular base leg 14D and an axially inwardly extending, annular terminal leg 14E.

The rotary metal screw shell or base 20, which is threaded at 25, is coupled in circuit to the other terminal 32A of the fluorescent bulb 12 via a wire 29. The light source 12 could also comprises a series of light emitting diodes (not shown) which emit light that is conducted from the diodes to a work area via a plurality of glass rods. It should be understood that rather than the screw shell or base 20, an electrically conductive bayonet base could be substituted. Also, rather than threads 25, the base 20 could include a bayonet connection which includes linear projections that are inserted into a complementally formed electrical socket and then turned or rotated about the rotational axis a.

A plurality of circumferentially spaced, radially outwardly extending ribs 30 are integrally formed with the outer surface of the annular side wall 14A for a purpose to become more apparent hereinafter.

Cantileverly permanently mounted on the base 14 of the fluorescent light bulb 12 is an electrically non-conductive, cylindrical housing 40. The housing 40 is fabricated from a pair of confronting, elongate, semi-cylindrical housing portions 42 and 44 including complementally formed, circumferentially spaced, male and female, mating edges or ends 46 and 48, respectively, which are sealed together, as illustrated in FIG. 3, by adhesive, sonic welding, a threaded coupling and/or suitable fasteners to form a hollow cylinder 41. The housing portion 42 is fabricated from clear translucent material such as Lexane® plastic which will readily transmit light emitted by the light source 12 in the direction of the arrow 31. If the work light is merely threaded into a complementally threaded electrical socket embedded in an insulated handle without a reflector, the other semi-cylindrical portion 44 comprises opaque plastic material and includes a layer 50 of reflectorized material, such as tin, aluminum, painted metal, or a coating of reflective material that is bonded to the inside of the semi-cylindrical half 44 for reflecting, concentrating and intensifying the light and directing it from one lateral side of the lamp to the laterally opposite side of the lamp as represented by the arrows 33 (FIG. 3). For commercial applications, the semi-cylindrical portion 44 may also be constructed of metal. If the work light 10 is utilized as a replacement for a conventional incandescent light bulb of a conventional trouble light having a reflector, the housing portion 42 may also be fabricated from clear translucent plastic material.

The semi-cylindrical housing portions 42 and 44 have an identical radius of curvature R, about the longitudinal axis a, and cooperate to form the cylindrical housing 40 which includes a longitudinally intermediate light emitting and reflecting portion 66 having a predetermined diameter 67 and an axial length 67A and axially outer and inner cylindrical end portions 68 and 70, respectively, having reduced diameters 69. The semi-cylindrical portions 42 and 44 cooperate to form the axially outer cylindrical portion 68 including a relatively short cylindrical side wall 74 having axially outer end wall portions cooperating to define the axially outer end wall 52 defining an aperture 54 therethrough for rotatably receiving the shank 55 of a hook 56 which is operative to suspend the portable light 10 on any fixture. A pair of axially spaced apart plates 58 are integrally formed with the shank 55 for rotatably securing the suspension hook 56 to the end wall 52.

Figure 5:
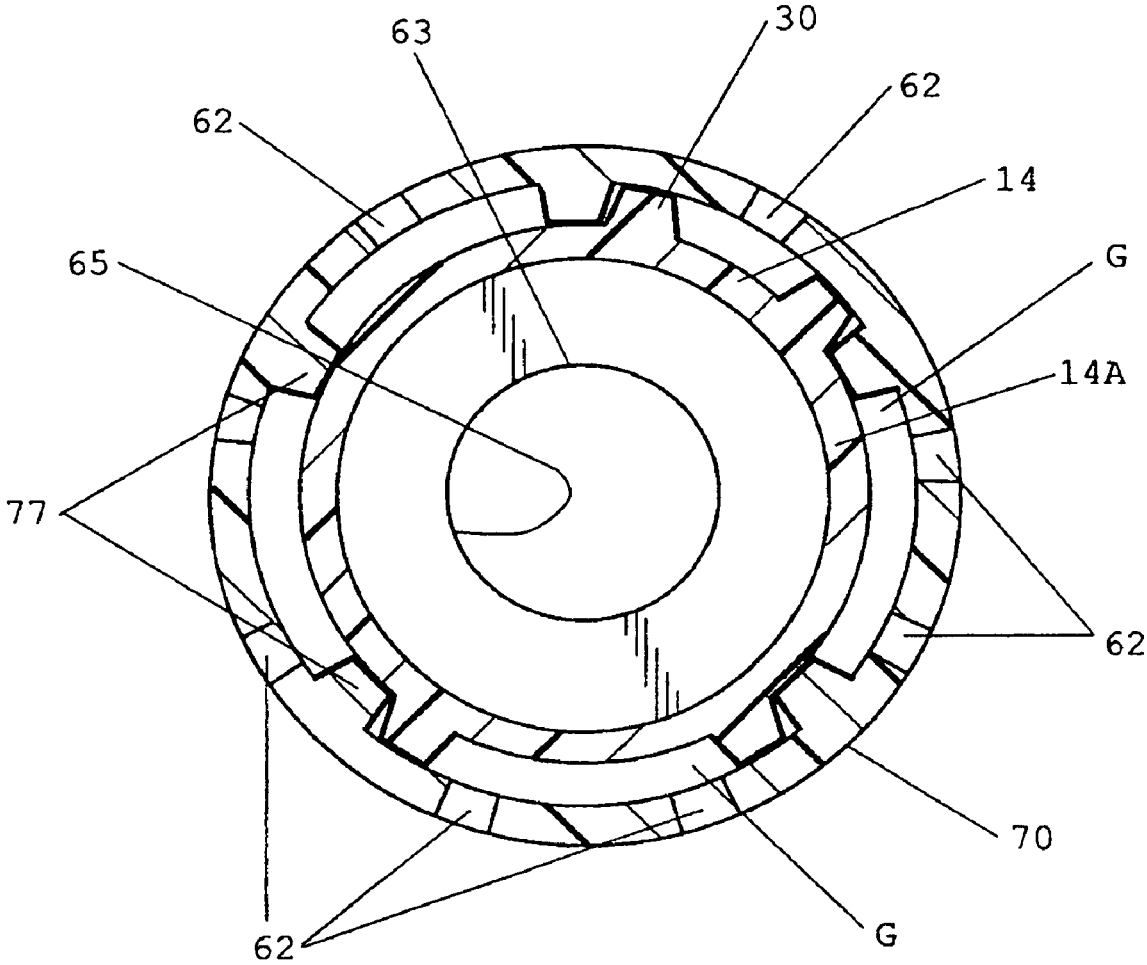
FIG. 5 is a slightly enlarged, top plan sectional view of the base, taken along the line 5—5 of FIG. 1.

The axially inner cylindrical end portion 70 has a side wall 71 is axially longer than the axially outer end portion 68 and includes an axially inwardly converging end wall 72 terminating in a rigid, transversely inwardly extending annular flange or ring 63 abutting the axially inner end of the flange 14D of the base 14 and defines an opening 65 which receives the terminal flange 14E. The side wall 71 and the axially inwardly converging frustoconically shaped wall 72 include a plurality of circumferentially spaced apart, radially inwardly projecting ribs 77 which mount the walls 71 and 72 in radially spaced relation with the walls 14A and 14B to provide a gap G therebetween (FIG. 5). The ribs 77 radially bear against the outer circumferential surface of base 14 and circumferentially bear against the ribs 30 of the rotary base 14 for insuring that the rotary base and cylinder housing 40 will rotate about the axis a in unison. The side walls 70 and 71 include a plurality of circumferentially spaced apart elongate slots 62 therethrough disposed between the ribs 77 for communicating ambient air to the gap G which allows inlet cooling air to enter in the direction of the arrow X to pass along the lamp 12 and thence outwardly through the slots 68A in the opposite end 68 in the direction of the arrows Y. The elongate gap G, formed circumferentially between the confronting ribs 30 and 77 and in radial alignment with the slot 62 in housing 70, allows ambient air to longitudinally axially longitudinally outwardly in the direction of the arrows S and Y to cool the lamp 12. The circumferentially spaced vent slots 68A provide outlet ventilation for any heat that may be generated by the fluorescent lamp 62.

Compared to linear fluorescent lights, the axial length 34 of the spiral lamp light portion 12C is relatively short and thus, the arial length 35 of housing mid portion 66 is also axially relatively short. Only the inner curvilinear half surface 66A of mid-portion 60 is reflectorized with a reflectorized coating 50. A layer of adhesive may be applied to the ribs 30 and the confronting ribs 77 and the inside surfaces of the housing to further seclude relative turning of a house 70 and the base 14 of the light bulb 12.

The electrically conductive rotary metal screw shell or base 20 of unit 10 is threaded about the elongate rotary axis a into a complementally formed electrical light terminal 81 having a complementally and electrically conductive light socket 80 mounted in an electrically non-conductive housing handle 82. The threaded electrically conductive socket 80 is electrically coupled to a source of electrical power via leads 88 and threadedly receives the rotary shell base 20. The user may easily thread the entire assembly 10 into the socket handle 80 by merely gripping the housing 40 and concurrently rotating it and the fluorescent bulb 12 about the longitudinal axis a. The housing handle 82 is radially spaced from the base 14 by a gap G1.

A vibration dampener and seal, generally designated 84, is provided and includes an annular flat ring or plate of resilient material, such as rubber, having a central aperture 85 snugly receiving the radially outer surface of the terminal base flange 14E so as to preclude the passage of liquid, such as ignitable and/or flammable gases or fluids or water therebetween. The resilient washer or vibration dampener and seal 84 projects radially outwardly a sufficient distance to cover the gap G1 between the non-conductive housing handle 82, and the rotary base 14. When the work light 10 is fully threaded into the socket 80, the radially outer portion 84 of the seal 84 is axially sandwiched between the flange 14D of the axially inner end of rotary base 14 and more particularly sandwiched between and abutting the flange 63 of the cantileverly supported housing 40 and the axially outer end 87 of the confronting annular housing handle 82 to absolutely preclude any ambient fluids from passing to the electrical socket 80.

The present invention may also be applied to existing light sockets having electrically conductive bayonet receptacle which receive a bayonet plug that can thereafter be rotated to its final operating position.

METHOD AND OPERATION

The apparatus constructed according to the present invention is manually rethreaded about the axis a into a socket 80 by merely gripping the housing 40 and concurrently turning it and the rotary metal screw shell 20 so that the screw base 20 is threadedly received in the complementally formed handle socket 80. When fully threaded into the socket, the radially outer portion 84A of the vibration dampener and seal 84 is sandwiched between the terminal end 87 of the housing handle 82 and the confronting rim 63 of the insulated housing 40 to close the gap G and preclude fluids, such as gas fumes and liquid from entering the gap G and coming into contact with the electrically conductive handle socket contact 80.

The slots 62 in the cylindrical wall 71, provide an air inlet for ambient air to be drawn inwardly, in the direction of the arrow X, over the fluorescent lamp 12, in the direction of the arrow 5, and then outwardly through the vent slots 68, in the direction of the arrow Y, via a so-called "chimney effect".

With the housing 40 secured to the base 14, the housing 40 will not move relative to the bulb 12 whereby breakage of the bulb 12 is minimized. In addition, the resilient shield 84 will absorb shock which would otherwise be transmitted from the handle 82 to the bulb 12.

When the fluorescent bulb 12 is no longer operative, the entire replacement light 10 is unthreaded from the handle socket 8 and the bulb 12, along with the reflector 50, protective housing 40, light source 12, base 14 including the electronic components 22, 24 and 28, mounting hook 56, and resilient shock absorber and seal 84 are concurrently discarded and a duplicate replacement installed.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

I claim:

1. In combination:

a light source having an electrically nonconductive rotary base provided with axially inner and outer ends and laterally opposite sides, a light emitting member having an axially inner end mounted on said axially outer end of said base, electrically conductive terminals mounted on said inner end of said base and adapted to be rotatably received in a complementally formed electrical light socket, and electrically conductive members, disposed in said base electrically coupling said terminals to said light emitting member; and an elongate disposable light reflector, cantileverly supported on said base, including an inner light reflecting surface disposed in a confronting relation with one of said lateral sides of said light emitting member for reflecting light emitted by said light emitting member and concentrating the light in a direction toward the other of said lateral sides of said light emitting member.

2. The combination set forth in claim 1 including an elongate cylindrical housing cantileverly supported on said base and enveloping said light emitting member; said housing comprising an elongate arcuate inner surface mounting said elongate reflector.

3. The combination set forth in claim 2 wherein said cylindrical housing includes complementally formed semi-cylindrical housing halves having complementally formed terminal edges disposed in abutting relation and sealed together along their lengths.

4. The combination set forth in claim 3 including a hook on said housing for detachably mounting said housing on a support.

5. The combination set forth in claim 4 wherein said housing includes an axially inner end mounted on said base and an axially outer end;

said hook being rotatably mounted on said axially outer end of said housing.

6. The combination set forth in claim 1 wherein said cylindrical housing includes an axially inner end disposed on said axially inner end of said non-conductive rotary base and further including transversely disposed resilient means spanning said base and said inner end of said cylindrical housing to laterally stabilize said light emitting member, vibrationally isolate said light emitting member from said light socket, and seal said cylindrical housing to said base in fluid impervious relation.

7. The combination set forth in claim 2 wherein said light emitting member comprises a fluorescent light bulb including an axially outer portion having a spiral configuration of a predetermined axial extent.

8. The combination set forth in claim 7 wherein said housing includes a longitudinal cylindrical mid-section having a predetermined length and a predetermined diameter and longitudinally inner and outer cylindrical end sections having a reduced diameter less than said predetermined diameter.

9. The combination set forth in claim 8 wherein said predetermined length of said mid-section is substantially equal to said axial extent of said axially outer portion of said spiral fluorescent light bulb.

10. The combination set forth in claim 9 wherein at least one of said end sections includes a plurality of circumferentially spaced apart apertures therethrough for egress of any heat energy which might be emitted by said light emitting member within said housing.

11. The combination set forth in claim 9 wherein each said end sections each includes a plurality of circumferentially spaced apart elongate apertures therethrough.

12. The combination set forth in claim 1 wherein said reflector includes an axially inner end disposed on said inner end of said base; and further including resilient, transversely disposed, vibration dampening and sealing means axially abutting said axially inner end of said reflector for vibrationally isolating said light emitting member from the complementally formed light socket.

13. The combination set forth in claim 1 including a resilient, electrically non-conductive, transversely disposed sealing means abutting an axially inner end portion of said housing for being sealingly sandwiched between said axially inner end portion of said housing and the complementally formed light socket.

14. A disposable housing for a portable light source including an electrically nonconductive rotary base, rotatable about an axis, having axially inner and outer ends;

a light emitting member having laterally opposite sides and an axially inner end mounted on said axially outer end of said base;

electrically conductive terminals mounted on said inner end of said base and adapted to be rotatably received in a complementally formed electrical light socket; and electrical conductive members, disposed in said base, coupling said terminals to said light emitting member;

said housing comprising an elongate light reflector including a laterally inner light reflecting surface; and mount means for cantileverly mounting said elongate light reflector on said base with said laterally inner light reflecting surface disposed in confronting relation with one of lateral sides of said light emitting member for reflecting and concentrating light emitted by said light emitting member in a direction toward said laterally opposite side of said light emitting member.

15. The housing set forth in claim 14 wherein said mount means includes an elongate hollow cylinder cantileverly supported on said base and enveloping said light member; said hollow cylinder having an elongate, arcuate inner surface, concentric about said axis, mounting said elongate reflector.

16. The housing set forth in claim 15 wherein said cylinder includes complementally formed semicylindrical housing halves having complementally formed terminal edges disposed in abutting relation and sealed together along their lengths.

17. The housing set forth in claim 16 including a mounting hook on said housing for detachably mounting said housing on a support.

18. The housing set forth in claim 17 wherein said cylinder includes an axially inner end mounted on said base and an axially outer end;

said hook being rotatably mounted on said axially outer end of said housing.

19. The housing set forth in claim 14 further including a transversely disposed resilient plate spanning said rotary base and said cylindrical housing for laterally stabilizing said light emitting member, vibrationally isolating said light emitting member, and for sealing said cylindrical housing to said rotary base in fluid impervious relation.

20. The housing set forth in claim 15 wherein said light emitting member comprises a fluorescent light including an axially outer light emitting spiral portion bulb having a predetermined axial extent.

21. The housing set forth in claim 20 wherein said cylinder includes a longitudinal cylindrical mid-section having a predetermined length and a predetermined diameter, and longitudinally inner and outer cylindrical end sections coupled to opposite ends of said cylindrical mid-section having a reduced diameter less than said predetermined diameter.

22. The housing set forth in claim 21 wherein said predetermined length of said mid-section is substantially equal to said predetermined axial extent of said axially outer portion of said fluorescent light bulb.

23. The housing set forth in claim 22 wherein at least one of said end sections include a plurality of circumferentially spaced apart apertures therethrough for egress of any heat energy which might be emitted by said light emitting member within said housing.

24. The housing set forth in claim 22 wherein each of said end sections each includes a plurality of elongate circumferentially spaced apart elongate apertures therethrough for the passage of ambient air therethrough to dissipate any heat within said cylinder.

25. The housing set forth in claim 14 wherein said mount means includes an axially inner end disposed on said inner end of said base; and further including a resilient transversely disposed vibration dampening and sealing means axially abutting said inner end of said reflector and snugly resiliently engaging said base for vibrationally isolating said light emitting member.

26. The housing set forth in claim 14 wherein said mount means includes an axially inner end disposed on said axially inner end of said base; and further including a resilient, electrically nonconductive, transversely disposed sealing means received on said base and abutting said axially inner end portion of said mount means and of such dimensions to be sandwiched between said axially inner end of said mount means and the complementally formed light socket.

27. The housing set forth in claim 14 wherein said mount means comprises a plurality of complementally elongate formed arcuate sections, having the same radius of curvature, disposed with their terminal edges abutting and bonded together to form a cylinder having a longitudinal mid-section provided with radially inner and outer surfaces and a predetermined diameter, and longitudinally spaced cylindrical end sections of a lesser diameter; and said reflector comprises a light reflective coating applied only to a portion of said inside surface of said mid-section along one lateral side of said light emitting member.

28. The housing set forth in claim 27 wherein said cylinder includes end sections on axially opposite ends of said mid-section including ventilation apertures for axially passing ambient cooling air therethrough.

29. The housing set forth in claim 27 wherein said cylinder includes an axially inner cylindrical end section; and cooperating means on said base and said inner cylindrical end section for precluding relative rotation thereof about the longitudinal axis of the cylinder.

30. The housing set forth in claim 29 wherein said cooperating means includes radially extending, elongate ribs integrally formed on one of said base and said axially inner cylindrical end section to define at least one elongate gap therebetween.

31. The housing set forth in claim 30 wherein said axially inner cylindrical end section includes at least one ventilation aperture therethrough in fluid communication with said elongate gap.

32. In combination:

an electrically conductive annular light socket, having a longitudinally extending axis for rotatably receiving a lamp;

an electrically nonconductive annular socket housing, having an axially outer free terminal end, surrounding said light socket;

a light source having an axially inner rotary base including an electrically conductive portion formed complementally to said socket for being detachably rotatably received by said socket; and electrically nonconductive stabilizing and sealing means mounted on said base, radially spanning said rotary base and said housing in fluid impervious relation to preclude any ambient liquid from inadvertently axially entering between said housing and said rotary base and to dampen and absorb any vibration from being inadvertently transmitted from said housing to said light source.

33. The combination set forth in claim 32 wherein said stabilizing and sealing means comprises an annular resilient plate having a central aperture snugly resiliently receiving an axially inner portion of said base.

34. The combination set forth in claim 28 wherein said resilient plate comprises rubber.

35. The combination set forth in claim 32 wherein a portion of said stabilizing and sealing means is clamped between said base and said housing.

36. A disposable light assembly including:

a light source having a light emitting end, and an opposite rotary end including an electrically nonconductive base and an electrically conductive portion on said base for coupling said light emitting end to a source of electrical power; and an electrically nonconductive cylindrical housing having an elongate cylindrical sidewall, of a predetermined diameter and radially outwardly spaced from said light emitting end, provided with an axially inner open ended end, having a reduced diameter, less than said predetermined diameter, snugly receiving and sealed to said base for movement therewith.

37. The disposable light assembly set forth in claim 36 wherein said housing includes an axially outer end wall closing said side wall; and a mounting hook swivelably mounted on said end wall.

38. The disposable light assembly set forth in claim 36 wherein said axially inner open ended end includes a plurality of axially extending, circumferentially spaced apart slots separated by ribs integral with said cylindrical sidewall.

39. The disposable set forth in claim 38 wherein said electrically nonconductive cylindrical housing includes an axially outer terminal end wall spanning said sidewall and including an opening therethrough; and further including an attaching hook rotatably mounted on said opening in end wall.

40. The disposable light assembly set forth in claim 36 wherein said housing includes a radially inner surface; a portion of said inner surface including a layer of light reflecting material thereon for reflecting light rays emitted by said light source in one direction and concentrating the light rays in an opposite direction.

41. The disposable light assembly set forth in claim 34 wherein said housing comprises complementally formed arcuate housing portions disposed in abutting sealed relation with each adjacent arcuate housing portion; at least one of said arcuate housing portions having a radially inner portion covered by a layer of light reflecting material for concentrating the reflected light.

42. The disposable light assembly set forth in claim 41 wherein said housing includes a ventilation aperture therethrough for receiving outwardly passing ambient heat generated by said light source.

43. The disposable light assembly set forth in claim 36 further including sealing and shock absorbing means for sealing the light assembly to the source of electrical power to preclude the inadvertent passage of fluid to a source of electrical power and for vibrationally isolating said light source from the source of electrical power.

44. The disposable light assembly set forth in claim 43 wherein said sealing and shock absorbing means comprises a resilient annular member having an aperture receiving said rotary end and including an annular rim for being sandwiched between said light source the source of electrical power for vibrationally isolating said light source.

45. A housing for a light source having an electrically nonconductive base mounting electrically conductive terminals at an inner end adapted to be rotatably received in a complementally formed electrical socket and a light emitting member at an opposite outer end; said housing comprising:

an elongate hollow tubular disposable cylinder, cantileverly mounted on said base, having a longitudinal mid-section of a predetermined diameter for receiving said light emitting member and a pair of axially opposite end members, at least one of said end members having a reduced diameter for snugly receiving said nonconductive base and including an open ended end aperture through which said electrical conductive terminals pass;

said longitudinal mid-section having a radially inner surface; and a light reflector mounted on a portion of said radially inner surface for reflecting and concentrating the light emitted by said light emitting member.

46. A vibration dampener and seal for a lighting fixture including a light source having a light emitting outer end and an electrically nonconductive, rotary base at its opposite inner end mounting an electrically conductive terminal for detachable connection to a complementally formed electrical socket; and an electrically non-conductive disposable housing, having an annular, axially inner terminal end mounted on said non-conductive rotary base;

said vibration dampener and seal comprising:

a liquid impervious sealing plate disposed transversely on said base and spanning said base and said axially inner end of said housing and adapted to be sandwiched between and sealed to said axially inner end of said housing and a portion of the socket.

47. The vibration dampener and seal set forth in claim 46 wherein said sealing plate is resilient.

48. The vibration dampener and seal set forth in claim 46 wherein said sealing plate comprises an annular resilient ring having a central aperture therethrough receiving said base and spanning said housing to preclude water from passing between said base and said housing.

49. The vibration dampener and seal set forth in claim 42 wherein said resilient ring comprises a sheet of flexible rubber having a radially outer annular rim portion for being sandwiched between said axially inner end of said housing and the socket.

50. A disposable work light including an electrically energizable lamp have a light emitting outer end and a rotary base at its opposite inner end mounting electrical contacts for detachable connection to a complementally formed electrical socket; and an elongate housing having an inner end cantileverly mounted on said base of the lamp for disposal therewith and an outer end; and a mounting hook mounted on said outer end for detachably supporting said lamp on a support;

said housing comprising a cylinder having one curvilinear translucent section and another curvilinear reflector section for reflecting and concentrating the light emanating from said light emitting outer end in a direction toward said one translucent section; said lamp comprising a fluorescent light bulb including a light emitting axially outer end having a spiral configuration.

51. The work light set forth in claim 50 wherein said base and said housing include complementally formed radially extending sections which cooperate to inhibit relative rotation of the housing and said base of said lamp.

52. The work light set forth in claim 51 wherein said housing comprises a hollow cylinder having an axially end wall provided with an aperture which snugly receives said base.

53. The work light set forth in claim 51 further including electrically nonconductive vibration dampening and isolating means mounted on said base and including an annular resilient plate, abutting an axially inner end of said elongate housing, for being sandwiched between said inner end of said housing and the complementally formed socket.

54. A replacement light source for an incandescent bulb used in a mechanic's work light, comprising:

a compact, energy-efficient light source;

a protective housing enclosure permanently, cantileverly fixed to said light source;

a reflective surface on a portion of said housing for projecting and intensifying the light emitted by said light source to the surface of a work area; and an attaching hook swivelably mounted on said housing for supporting the replacement light source on a fixture.

55. The replacement light source according to claim 54 wherein said protective housing enclosure is circular in cross section and comprises two semi-cylindrical housing portions each of which include circumferentially spaced, elongate mating edges which abut and are permanently sealed to the mating edges of the other semi-cylindrical housing portion.

56. The replacement light source according to claim 55 wherein said reflective surface on a portion of the protective housing comprises a semi-cylindrical reflector extending along one lateral side of said light source for reflecting and concentrating the light towards the work area.

57. The replacement light source according to claim 56 that produces low amounts of heat and includes a threaded shell base that detachably threads into the mechanic's work light.

58. The replacement light source according to claim 55 wherein said energy efficient light source comprises a fluorescent lamp and a transformer.

59. The replacement light source set forth in claim 57 wherein said energy efficient light source comprises an arrangement of light emitting diodes.

60. A disposable light assembly for an electrical outlet disposed in an electrically non-conductive handle, said light assembly comprising:

a light source having an electrically conductive rotary base, rotatable about an elongate axis, for detachably mating with the electrical outlet;

a light emitting member; and an electrically conductive base having an axially inner end mounting said rotary base and an axially outer end mounting said light emitting member;

means in said nonconductive base for coupling said rotary base and said light emitting member in electrical circuit relation;

an electrically non-conductive elongate cylindrical housing having an axially inner end mounted on said base and an axially outer end surrounding said light emitting member; and means for sealing said light assembly to the non-conductive handle in fluid impervious relation and for vibrationally isolating said light emitting member from the handle.

61. The light assembly set forth in claim 60 wherein said means for sealing and vibrationally isolating comprises resilient means for sealing an axially inner end of said light assembly to the handle in fluid impervious relation.

62. The light assembly set forth in claim 60 wherein said means for sealing and vibrationally isolating comprises a resilient annular ring axially disposed between said axially inner end of said non-conductive base and the non-conductive handle.

63. The light assembly set forth in claim 60 wherein said means for sealing and vibrationally isolating comprises an annular resilient vibrational stabilizing means for being sandwiched between said light assembly and the non-conductive handle.

64. The light assembly set forth in claim 60 wherein said means for sealing and vibrationally isolating comprises an annular resilient ring for being sandwiched between said axially inner end of said housing and the non-conductive handle.

65. The light assembly set forth in claim 64 wherein said annular resilient ring includes an aperture receiving said base.

66. The light assembly set forth in claim 60 wherein said means for sealing and isolating comprises a resilient plate spanning and sealed in fluid impervious relation to said rotary base and said axially inner end of said cylindrical housing.

67. A disposable work light including an electrically energizable lamp have a light emitting outer end and a rotary base at its opposite inner end mounting electrical contacts for detachable connection to a complementally formed electrical socket; and an elongate housing having an inner end permanently fixed to said base of the lamp for disposal therewith and a cantileverly supported outer end; and a mounting hook mounted on said outer end for detachably supporting said lamp on a support.

68. The work light set forth in claim 67 wherein said housing comprises a cylinder having one curvilinear translucent section and another curvilinear reflector section for reflecting and concentrating the light emanating from said light emitting outer end in a direction toward said one translucent section.

* * * * *